US009747861B2

(12) United States Patent
Nam et al.

(10) Patent No.: US 9,747,861 B2
(45) Date of Patent: Aug. 29, 2017

(54) DRIVING VOLTAGE GENERATING DEVICE, DISPLAY DEVICE INCLUDING THE SAME, AND METHOD OF GENERATING DRIVING VOLTAGE

(71) Applicant: SAMSUNG DISPLAY CO., LTD., Yongin, Gyeonggi-Do (KR)

(72) Inventors: Yang Uk Nam, Seoul (KR); Jong Jae Lee, Hwaseong-si (KR); Bon-Sung Koo, Seongnam-si (KR); Jun Dal Kim, Asan-si (KR); Se Young Heo, Seoul (KR); Jun Ki Hong, Bucheon-si (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 22 days.

(21) Appl. No.: 14/306,879

(22) Filed: Jun. 17, 2014

(65) Prior Publication Data

US 2015/0194085 A1 Jul. 9, 2015

(30) Foreign Application Priority Data

Jan. 3, 2014 (KR) ..... 10-2014-0000749

(51) Int. Cl.
*G09G 3/36* (2006.01)
*G09G 3/3208* (2016.01)

(52) U.S. Cl.
CPC ..... *G09G 3/3696* (2013.01); *G09G 3/3208* (2013.01); *G09G 2330/028* (2013.01)

(58) Field of Classification Search
None
See application file for complete search history.

(56) References Cited

U.S. PATENT DOCUMENTS

| | | | | |
|---|---|---|---|---|
| 7,561,087 | B2 | 7/2009 | Mechnig | |
| 2009/0243989 | A1 | 10/2009 | Lee et al. | |
| 2010/0033415 | A1* | 2/2010 | Bae | G09G 3/3696 345/94 |
| 2011/0175892 | A1* | 7/2011 | Lee | G09G 3/3696 345/212 |
| 2012/0326725 | A1 | 12/2012 | Sugeno et al. | |
| 2013/0088477 | A1 | 4/2013 | Seong et al. | |
| 2013/0093746 | A1 | 4/2013 | Zhao | |
| 2013/0187624 | A1 | 7/2013 | Wakasugi | |

FOREIGN PATENT DOCUMENTS

| | | |
|---|---|---|
| JP | 2011-027959 | 2/2011 |
| JP | 2012141477 | 7/2012 |

* cited by examiner

*Primary Examiner* — Seokyun Moon
(74) *Attorney, Agent, or Firm* — F. Chau & Associates, LLC

(57) ABSTRACT

A driving voltage generating device, a display device including the same, and a method of generating a driving voltage are provided. The driving voltage generating device includes a driving voltage setting unit receiving initially set data on a driving voltage and a feedback voltage and outputting a control signal, a driving voltage trimmer receiving finely adjusted data on the driving voltage and adjusting the feedback voltage, and a DC to DC converter generating the driving voltage based on the control signal and an input voltage.

21 Claims, 14 Drawing Sheets

FIG. 5

| Code | AVDD |
|---|---|
| 127 | +6.3% |
| 126 | +6.2% |
| 125 | +6.1% |
| ⋮ | ⋮ |
| 66 | +0.2% |
| 65 | +0.1% |
| 64 (default) | AVDD Setting |
| 63 | -0.1% |
| 62 | -0.2% |
| ⋮ | ⋮ |
| 2 | -6.2% |
| 1 | -6.3% |
| 0 | -6.4% |

FIG. 7

| DATA_SET (HEX) | AVDD Voltage | DATA_SET (HEX) | AVDD Voltage | DATA_SET (HEX) | AVDD Voltage | DATA_SET (HEX) | AVDD Voltage |
|---|---|---|---|---|---|---|---|
| 86h | 13.5 V | 95h | 15.0 V | A4h | 16.5 V | B3h | 18.0 V |
| 87h | 13.6 V | 96h | 15.1 V | A5h | 16.6 V | B4h | 18.1 V |
| 88h | 13.7 V | 97h | 15.2 V | A6h | 16.7 V | B5h | 18.2 V |
| 89h | 13.8 V | 98h | 15.3 V | A7h | 16.8 V | B6h | 18.3 V |
| 8Ah | 13.9 V | 99h | 15.4 V | A8h | 16.9 V | B7h | 18.4 V |
| 8Bh | 14.0 V | 9Ah | 15.5 V | A9h | 17.0 V | B8h | 18.5 V |
| 8Ch | 14.1 V | 9Bh | 15.6 V | AAh | 17.1 V | B9h | 18.6 V |
| 8Dh | 14.2 V | 9Ch | 15.7 V | ABh | 17.2 V | BAh | 18.7 V |
| 8Eh | 14.3 V | 9Dh | 15.8 V | ACh | 17.3 V | BBh | 18.8 V |
| 8Fh | 14.4 V | 9Eh | 15.9 V | ADh | 17.4 V | BCh | 18.9 V |
| 90h | 14.5 V | 9Fh | 16.0 V | AEh | 17.5 V | BDh | 19.0 V |
| 91h | 14.6 V | A0h | 16.1 V | AFh | 17.6 V | BEh | 19.1 V |
| 91h | 14.7 V | A1h | 16.2 V | B0h | 17.7 V | BFh | 19.2 V |
| 91h | 14.8 V | A2h | 16.3 V | B1h | 17.8 V | C0h | 19.3 V |
| 91h | 14.9 V | A3h | 16.4 V | B2h | 17.9 V | C1h | 19.4 V |

FIG. 8

| DATA_SET : 94 h, AVDD=14.9 V | | DATA_SET : 95 h, AVDD=15.0 V | | DATA_SET : 96 h, AVDD=15.1 V | |
|---|---|---|---|---|---|
| Code | AVDD Voltage | Code | AVDD Voltage | Code | AVDD Voltage |
| ... | ... | ... | ... | ... | ... |
| 57 | 14.796 V | 57 | 14.895 V | 57 | 14.994 V |
| 58 | 14.811 V | 58 | 14.910 V | 58 | 15.009 V |
| 59 | 14.826 V | 59 | 14.925 V | 59 | 15.025 V |
| 60 | 14.840 V | 60 | 14.940 V | 60 | 15.040 V |
| 61 | 14.855 V | 61 | 14.955 V | 61 | 15.055 V |
| 62 | 14.870 V | 62 | 14.970 V | 62 | 15.070 V |
| 63 | 14.885 V | 63 | 14.985 V | 63 | 15.085 V |
| 64 | 14.9 V | 64 | 15 V | 64 | 15.1 V |
| 65 | 14.915 V | 65 | 15.015 V | 65 | 15.115 V |
| 66 | 14.930 V | 66 | 15.030 V | 66 | 15.130 V |
| 67 | 14.945 V | 67 | 15.045 V | 67 | 15.145 V |
| 68 | 14.960 V | 68 | 15.060 V | 68 | 15.160 V |
| 69 | 14.975 V | 69 | 15.075 V | 69 | 15.176 V |
| 70 | 14.989 V | 70 | 15.090 V | 70 | 15.091 V |
| 71 | 15.004 V | 71 | 15.105 V | 71 | 15.106 V |
| ... | ... | ... | ... | ... | ... |

FIG. 11
(RELATED ART)

| Sample | AVDD |
|---|---|
| # 1 | 17.31 V |
| # 2 | 17.31 V |
| # 3 | 17.30 V |
| # 4 | 17.33 V |
| # 5 | 17.35 V |
| # 6 | 17.31 V |
| # 7 | 17.34 V |
| # 8 | 17.34 V |
| # 9 | 17.33 V |
| # 10 | 17.41 V |
| # 11 | 17.40 V |
| # 12 | 17.49 V |

DRIVING VOLTAGE GENERATING DEVICE, DISPLAY DEVICE INCLUDING THE SAME, AND METHOD OF GENERATING DRIVING VOLTAGE

CROSS-REFERENCE TO RELATED APPLICATION

This application claims priority to Korean Patent Application No. 10-2014-0000749 filed in the Korean Intellectual Property Office on Jan. 3, 2014, the disclosure of which is incorporated by reference herein in its entirety.

TECHNICAL FIELD

Exemplary embodiments of the present invention relate generally to displays, and more specifically, to a driving voltage generating device, a display device including the same, and a method of generating a driving voltage.

DISCUSSION OF THE RELATED ART

A display device, such as a liquid crystal display (LCD) or an organic light emitting diode (OLED), includes driving devices. Examples of the driving devices include a driving voltage generator generating driving voltages, a gate driver generating gate signals, a data driver generating data voltages, a reference grayscale voltage generator supplying reference grayscale voltages to the data driver, and a signal controller controlling the driving voltage generator, the gate driver, the data driver, and the reference grayscale voltage generator. An increased gap between the driving voltages or between the driving voltages and a target driving voltage may deteriorate the display quality of the display device.

SUMMARY

An exemplary embodiment of the present invention provides a driving voltage generating device. The driving voltage setting unit includes a driving voltage setting unit receiving initially set data on a driving voltage and a feedback voltage and outputting a control signal. A driving voltage trimmer receives finely adjusted data on the driving voltage and adjusts the feedback voltage. A DC to DC converter generates the driving voltage based on the control signal and an input voltage.

An exemplary embodiment of the present invention provides a display device includes a display panel including a plurality of pixels and a plurality of signal lines. A data driver applies a data voltage to the plurality of signal lines. A driving voltage generator includes at least one driving voltage generating device generating the driving voltage. A gamma voltage generator receives the driving voltage and generates a plurality of reference grayscale voltages. A timing controller controls the gamma voltage generator, the driving voltage generator, and the data driver. The driving voltage generating device includes a driving voltage setting unit receiving initially set data on the driving voltage and a feedback voltage and outputting a control signal. A driving voltage trimmer receives finely adjusted data on the driving voltage and adjusts the feedback voltage. A DC to DC converter generates the driving voltage based on the control signal and an input voltage.

The driving voltage trimmer may include a transistor allowing different currents to flow depending on the finely adjusted data.

The driving voltage setting unit may include a first digital to analog converter receiving the initially set data. A first amplifier receives a first reference voltage from the first digital to analog converter and the feedback voltage. A second amplifier receives an output voltage of the first amplifier and outputs the control signal. The driving voltage trimmer may include a second digital to analog converter receiving the finely adjusted data. A third amplifier receives a second reference voltage from the second digital to analog converter. The transistor includes a control terminal receiving an output voltage of the third amplifier.

The driving voltage generating device may further include a feedback sensing unit connected to an output terminal of the DC to DC converter. The feedback sensing unit may include first and second resistors connected in series with the output terminal. The feedback voltage may be sensed at a first node between the first resistor and the second resistor and be input to the second amplifier. A first terminal of the transistor may be connected to the first node.

The driving voltage trimmer may further include a third resistor connected to a second terminal of the transistor. The second terminal of the transistor may be connected to the third amplifier.

The driving voltage trimmer may further include a first memory storing the finely adjusted data.

The initially set data and the finely adjusted data may be received through an $I^2C$ interface.

The first to third resistors may satisfy the following equation:

$$R3=R2\times\{R1/(R1+R2)\}\times[\{M-(\text{default}+1)\}/2^n],$$

where R1 indicates a resistance of the first resistor, R2 indicates a resistance of the second resistor, R3 indicates a resistance of the third resistor, M is a natural number larger than 1, and default indicates a default value of the finely adjusted data.

An exemplary embodiment of the present invention provides a method of generating a driving voltage by a driving voltage generating device. The driving voltage generating device includes a driving voltage setting unit, a driving voltage trimmer, and a DC to DC converter. The method includes receiving initially set data and finely adjusted data on a driving voltage from an outside source. The initially set data is converted into a first reference voltage by the driving voltage setting unit. The finely adjusted data is converted into a second reference voltage by the driving voltage trimmer. A magnitude of a current flowing in a transistor included in the driving voltage trimmer is adjusted by the driving voltage trimmer according to the second reference voltage. A difference between a feedback voltage depending on the current flowing in the transistor and the first reference voltage is amplified by the driving voltage setting unit, outputting a first output voltage. The first output voltage is compared with a reference signal by the driving voltage setting unit, outputting a control signal. The driving voltage is generated by the DC to DC converter according to the control signal.

The driving voltage generating device may further include a feedback sensing unit connected to an output terminal of the DC to DC converter. The feedback sensing unit may include first and second resistors connected in series with the output terminal. The feedback voltage may be sensed at a first node between the first resistor and the second resistor. A first terminal of the transistor may be connected to the first node.

The driving voltage trimmer may include a third resistor connected to a second terminal of the transistor.

The initially set data and the finely adjusted data may be received through an $I^2C$ interface.

According to an exemplary embodiment of the present invention, a driving voltage generating device comprises a driving voltage setting unit configured to receive first data for initially setting a driving voltage and a feedback voltage and configured to output a control signal based on the initial data and the feedback voltage. The feedback voltage is a divided voltage of the driving voltage. A driving voltage trimmer is configured to receive second data for adjusting the driving voltage and configured to adjust the feedback voltage depending on the number of bits assigned to the second data. A DC to DC converter is configured to generate the driving voltage based on the control signal and an input voltage.

BRIEF DESCRIPTION OF THE DRAWINGS

A more complete appreciation of the present disclosure and many of the attendant aspects thereof will be readily obtained as the same becomes better understood by reference to the following detailed description when considered in connection with the accompanying drawings, wherein:

FIG. 5 is a table showing adjusted amounts of a driving voltage AVDD depending on finely adjusted data Code input to a trimmer of a driving voltage generating device according to an exemplary embodiment of the present invention;

FIG. 7 is a table showing illustrative magnitudes of driving voltages depending on initially set data DATA_SET input to a driving voltage generating device according to an exemplary embodiment of the present invention;

FIG. 8 is a table showing illustrative magnitudes of driving voltages depending on initially set data DATA_SET and finely adjusted data Code input to a driving voltage generating device according to an exemplary embodiment of the present invention;

FIG. 11 is a table showing values of driving voltages generated by a plurality of driving voltage generating devices according to the related art.

DETAILED DESCRIPTION OF EMBODIMENTS

Figure 1:
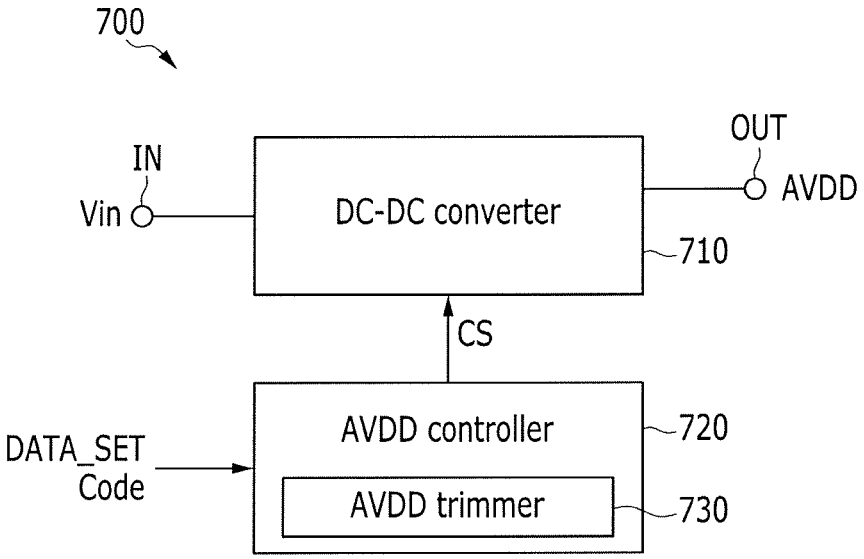
FIG. 1 is a block diagram of a driving voltage generating device according to an exemplary embodiment of the present invention.

Exemplary embodiments of the present invention will be described in detail hereinafter with reference to the accompanying drawings. Like reference numerals may designate like or similar elements throughout the specification and the drawings.

It will be understood that when an element or layer is referred to as being "on," "connected to," or "adjacent to" another element or layer, it can be directly on, connected, or adjacent to the other element or layer, or intervening elements or layers may be present. As used herein, the singular forms "a," "an," and "the" are intended to include the plural forms as well, unless the context clearly indicates otherwise.

Figure 2:
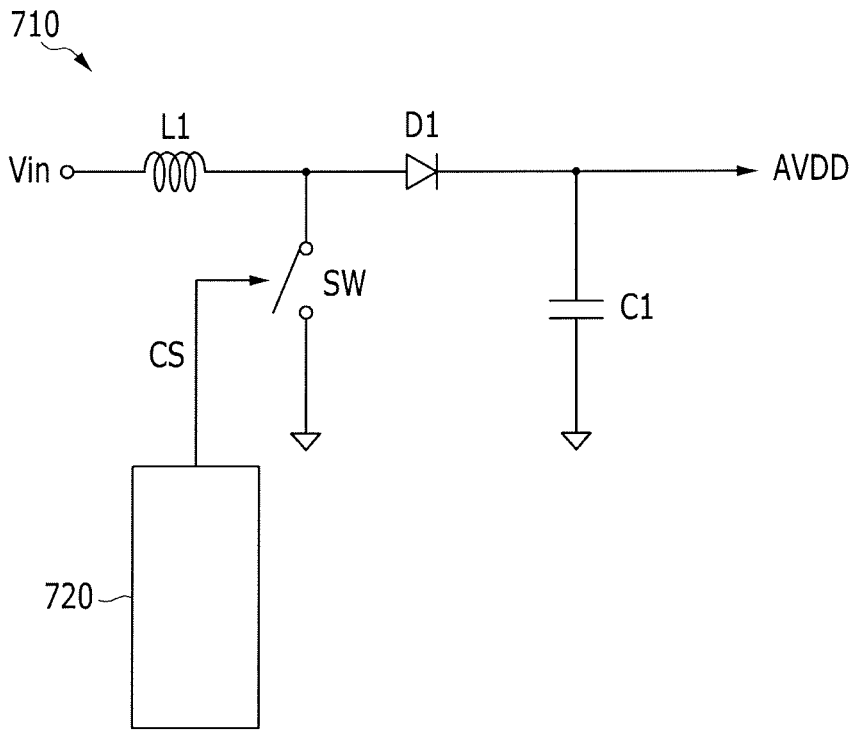
FIG. 2 is a circuit diagram of a direct current (DC) to DC converter included in a driving voltage generating device according to an exemplary embodiment of the present invention.
Figure 3:
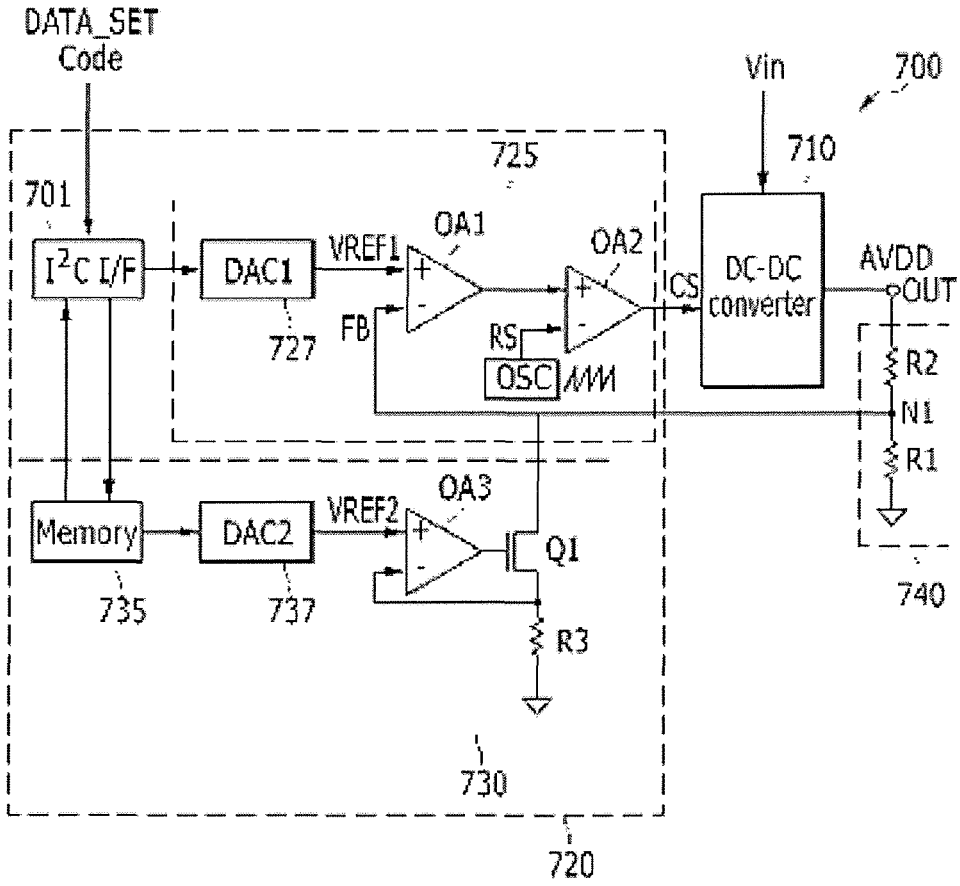
FIGS. 3 and 4 are circuit diagrams of driving voltage generating devices according to exemplary embodiments of the present invention.

FIG. 1 is a block diagram of a driving voltage generating device according to an exemplary embodiment of the present invention, FIG. 2 is a circuit diagram of a direct current (DC) to DC converter included in a driving voltage generating device according to an exemplary embodiment of the present invention, and FIG. 3 is a circuit diagram of a driving voltage generating device according to an exemplary embodiment of the present invention.

Referring to FIG. 1, a driving voltage generating device 700 according to an exemplary embodiment of the present invention generates a driving voltage AVDD. The driving voltage generating device 700 include a DC to DC converter 710 and a driving voltage controller 720. As shown in FIG. 3, the driving voltage generating device 700 may further include a feedback sensing unit 740.

The DC to DC converter 710 receives an input voltage Vin through an input terminal IN and generates a driving voltage AVDD based on a control signal CS from the driving voltage controller 720. The DC to DC converter 710 outputs the generated driving voltage AVDD through an output terminal OUT.

Referring to FIG. 2, the DC to DC converter 710 according to an exemplary embodiment of the present invention may be a boost converter receiving the input voltage Vin, a DC voltage, and outputting the driving voltage AVDD, a relatively high DC voltage. The DC to DC converter 710 according to an exemplary embodiment of the present invention may include an inductor L1, a diode D1, a switching element SW, and a capacitor C1. The switching element SW may be switched on/off depending on the control signal CS from the driving voltage controller 720.

The DC to DC converter 710 may generate the driving voltage AVDD depending on magnetic energy of the inductor L1 and charging energy of the capacitor C1 that are generated as the switching element SW switches on and off depending on the control signal CS.

Referring to FIG. 3, the feedback sensing unit 740 is connected to the output terminal OUT of the DC to DC converter 710. The feedback sensing unit 740 may include first and second resistors R1 and R2 connected in series with each other and sensing a current to feed back the driving voltage AVDD.

Referring back to FIG. 1, the driving voltage controller 720 receives initially set data DATA_SET and finely adjusted data Code from an outside source and generates the control signal CS that may adjust a magnitude of the driving voltage AVDD based on the initially set data DATA_SET and the finely adjusted data Code.

Referring to FIGS. 1 and 3, the driving voltage controller 720 according to an exemplary embodiment of the present invention includes a receiver 701, a driving voltage setting unit 725, and a driving voltage trimmer 730.

The receiver 701 receives the initially set data DATA_SET and the finely adjusted data Code from an outside source. The initially set data DATA_SET is data for setting a value of the driving voltage AVDD, and the finely adjusted data Code is data for finely adjusting a magnitude of the driving voltage AVDD. The initially set data DATA_SET and the finely adjusted data Code may be communicated through an interface such as an $I^2C$ (inter-integrated circuit) interface. A function of the $I^2C$ communication interface may be changed in software without changing hardware. The $I^2C$ communication interface may support a one-to-many communication function. The $I^2C$ interface may perform communication using two wires including a serial data (SDA) wire and a serial clock (SCL) wire. However, the communication interface for the initially set data DATA_SET and the finely adjusted data Code is not limited thereto, and various interfaces may be used.

The driving voltage setting unit 725 for setting the driving voltage AVDD generates the control signal CS. The driving voltage setting unit 725 may include a first digital to analog converter DAC1 727, a first amplifier OA1, and a second amplifier OA2.

The first digital to analog converter 727 may further include a register (not shown) receiving and storing the initially set data DATA_SET from the receiver 701. The first digital to analog converter 727 converts the initially set data DATA_SET into a first reference voltage VREF1 that is an analog voltage and inputs the first reference voltage VREF1 to the first amplifier OA1.

The first amplifier OA1 includes a non-inverting terminal receiving the first reference voltage VREF1 from the first digital to analog converter 727 and an inverting terminal receiving a feedback voltage FB. The feedback voltage FB may be input from the feedback sensing unit 740 connected to the output terminal OUT of the DC to DC converter 710. Referring to FIG. 3, a voltage at a first node N1 between the first and second resistors R1 and R2 included in the feedback sensing unit 740 may be input as the feedback voltage FB to the inverting terminal of the first amplifier OA1. The first amplifier OA1 may be a differential amplifier, and the first amplifier OA1 may output a signal that is proportional to a difference between the first reference voltage VREF1 and the feedback voltage FB.

The second amplifier OA2 includes a non-inverting terminal receiving an output of the first amplifier OA1 and an inverting terminal receiving a reference signal RS having a predetermined waveform from an oscillator OSC. The reference signal RS may have a saw-tooth wave signal. The second amplifier OA2 compares the output of the first amplifier OA1 with the reference signal RS and generates a control signal CS with a duty ratio changed depending on the comparison result. The control signal CS may control the switch-on/off of the switching element SW of the DC to DC converter 710.

The driving voltage trimmer 730 for finely adjusting the driving voltage AVDD may include a memory 735, a second digital to analog converter DAC2 737, a third amplifier OA3, a transistor Q1, and a third resistor R3.

The memory 735 receives and stores the finely adjusted data Code through the receiver 701. The capacity of the memory 735 may be 1 byte, but is not limited thereto. The memory 735 may be an electrically erasable and programmable read only memory (EEPROM).

Alternatively, the memory 735 may be omitted. In this case, the second digital to analog converter 737 may directly receive the finely adjusted data Code from the outside through the receiver 701 through, e.g., an $I^2C$ interface.

The second digital to analog converter 737 may further include a register (not shown) receiving and storing the finely adjusted data Code. The second digital to analog converter 737 converts the finely adjusted data Code into a second reference voltage VREF2, which is an analog voltage, and inputs the second reference voltage VREF2 to the third amplifier OA3.

The third amplifier OA3 includes a non-inverting terminal receiving the second reference voltage VREF2 from the second digital to analog converter 737 and an inverting terminal receiving a feedback voltage.

The transistor Q1 includes a control terminal receiving an output of the third amplifier OA3, a first terminal connected to the first node N1 of the feedback sensing unit 740, and a second terminal connected to the third resistor R3. One of the first and second terminals may be a source terminal, and the other thereof may be a drain terminal. The transistor Q1 may be a field effect transistor (FET), but is not limited thereto.

The third resistor R3 may be connected between the second terminal of the transistor Q1 and a predetermined voltage source or a ground. The third resistor R3 may determine a magnitude of a drain current of the transistor Q1.

The inverting terminal of the third amplifier OA3 may be connected to the second terminal of the transistor Q1.

Figure 4:
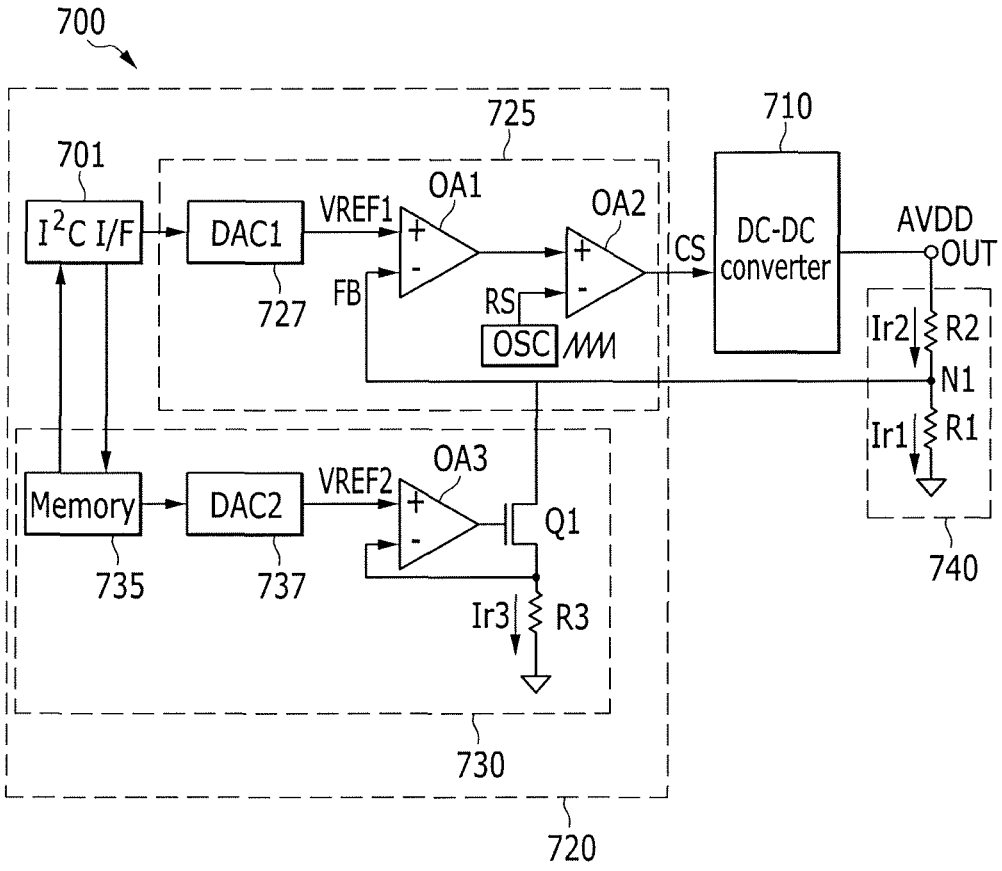

FIG. 4 is a circuit diagram of a driving voltage generating device according to an exemplary embodiment of the present invention, and FIG. 5 is a table showing adjusted amounts of a driving voltage AVDD depending on finely adjusted data Code input to a trimmer of a driving voltage generating device according to an exemplary embodiment of the present invention.

Referring to FIG. 4, the driving voltage generating device 700 is substantially the same as the driving voltage generating device 700 described above in connection with FIG. 3. In the driving voltage generating device 700 shown in FIG. 4, a current Ir1 flowing through a first resistor R1, a current Ir2 flowing through a second resistor R2, and a current Ir3 flowing through a third resistor R3 may be calculated by the following Equation 1:

$$Ir3 = \mathrm{VREF2}/R3$$

$$Ir1 = \mathrm{VREF1}/R1$$

$$Ir2 = Ir3 + Ir1 \qquad \text{[Equation 1]}$$

In the above Equation 1, R1 indicates a resistance of the first resistor R1, R2 indicates a resistance of the second resistor R2, and R3 indicates a resistance of the third resistor R3.

The driving voltage AVDD may be calculated by the following Equation 2:

$$\begin{aligned} AVDD &= VREF1 + R2 \times Ir2 \qquad \text{[Equation 2]} \\ &= VREF1 + R2 \times (VREF2/R3 + VREF1/R1) \\ &= \{(R1 + R2)/R1\} \times VREF1 + (R2/R3) \times VREF2 \end{aligned}$$

In the above Equation 2, (R2/R3)×VREF2 contributes to increasing or decreasing a current flowing in the transistor Q1, allowing the driving voltage AVDD to be finely adjusted.

When the number of bits allocated to the finely adjusted data Code is n (n indicates a natural number), the finely adjusted data Code may have values of 0 to $2^n-1$. For example, when the number of bits allocated to the finely adjusted data Code is 7 (n=7), the finely adjusted data Code may have values of 0 to 127, as shown in FIG. 5.

Using the first reference voltage VREF1, the second reference voltage VREF2 may be represented as shown in the following Equation 3:

$$VREF2=VREF1\times(1+Code)/2^n$$

$$VREF2=VREF1\times(1+Code)/128,\text{when } n=7 \qquad \text{[Equation 3]}$$

When the above Equation 3 is applied to the above Equation 2, the AVDD for the Code is represented by the following Equation 4:

$$AVDD(Code)=\{(R1+R2)/R1+(R2/R3)\}\times(default+1)/2^n\}\times VREF1+\{(R2/R3)\times(Code-default)/2^n)\times VREF1$$

$$AVDD(Code)=\{(R1+R2)/R1+(R2/R3\times(65/128)\}\times VREF1+\{(R2/R3)\times(Code-64)/128)\times VREF1,\ \text{when } n=7 \text{ and } default=2^{(n-1)}=64 \qquad \text{[Equation 4]}$$

In the above Equation 4, the first term ({(R1+R2)/R1+(R2/R3)}×(default+1)/$2^n$}×VREF1) represents a driving voltage AVDD before finely adjusted and indicates a magnitude of a default driving voltage (default AVDD) when the finely adjusted data Code is a default. In the above Equation 4, the second term ({(R2/R3)×(Code−default)/$2^n$)×VREF1) contributes to finely adjusting the driving voltage AVDD.

Referring to FIG. 5, when the finely adjusted data Code has 7 bits, a default value of the finely adjusted data Code may be 64, which is about an intermediate value of all the values, but the default value is not limited thereto. For example, the default value of the finely adjusted data Code may be a value other than the intermediate value. When the finely adjusted data Code has the default value, the driving voltage AVDD set to a default driving voltage (default AVDD) may be generated depending on the control signal CS output from the driving voltage setting unit 725.

When a finely adjusted ratio of the second term of the above Equation 4 with respect to a default driving voltage (default AVDD) or an adjusting resolution is, for the purpose of description, 1/M (M indicates a natural number larger than 1), the following Equation 5 is satisfied.

$$\{(R2/R3)\times(1/2^n)\times VREF1=(1/M)\times(R1+R2)/R1+(R2/R3\}\times(default+1)/2^n\}\times VREF1$$

$$\{(R2/R3)\times(1/128)\times VREF1=(1/M)\times\{(R1+R2)/R1+(R2/R3\}\times(65/128\}\times VREF1,\text{when } n=7 \text{ and } default=2^{(n-1)}=64 \qquad \text{[Equation 5]}$$

According to the above Equation 5, the third resistance R3 is determined by the following Equation 6.

$$R3=R2\times\{R1/(R1+R2)\}\times[\{M-(default+1)\}/2^n]$$

$$R3=R2\times\{R1/(R1+R2)\}\times\{(M-65\}/128),\text{when } n=7 \text{ and } default=64$$

$$R3=R2\times\{R1/(R1+R2)\}\times\{(1000-65\}/128),\text{when } n=7,\ default=64, M=1000 \qquad \text{[Equation 6]}$$

For example, the third resistance R3 is set as shown in the above Equation 6, and thus, the driving voltage AVDD may be adjusted by 1/M based on the default driving voltage (default AVDD) when a default value in n bits of finely adjusted data Code is a default. For example, when M is 1000, the driving voltage AVDD may be finely adjusted by ±0.1% with respect to the default driving voltage (default AVDD), as shown in FIG. 5.

Referring to FIGS. 1 and 3, the driving voltage controller 720 receives the initially set data DATA_SET and the finely adjusted data Code from an outside source through the receiver 701. For example, the driving voltage controller 720 may receive the initially set data DATA_SET and the finely adjusted DATA Code stored in an external memory such as an EEPROM, through the $I^2C$ interface.

The initially set data DATA_SET is data for setting an initial driving voltage AVDD before finely adjusted, and the initially set data DATA_SET is stored in a register of the driving voltage setting unit 725 included in the driving voltage generating device 700 depending on addresses allocated to the initially set data DATA_SET.

The finely adjusted data Code is data for finely adjusting the driving voltage AVDD, and the finely adjusted data Code is stored in a register of the driving voltage trimmer 730 included in the driving voltage generating device 700 depending on addresses allocated to the finely adjusted data Code. The finely adjusted data Code may also be stored in the memory 735.

Figure 6:
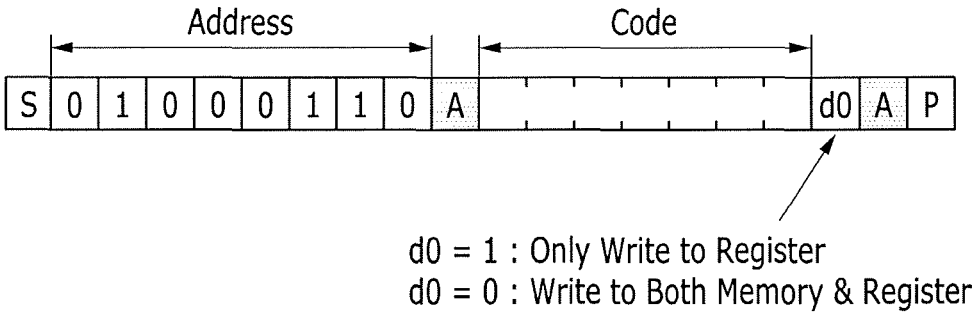
FIG. 6 is a diagram showing an example of serial data including finely adjusted data Code input to a driving voltage generating device according to an exemplary embodiment of the present invention.

FIG. 6 shows a serial data signal among interface signals received by the receiver 701. Referring to FIG. 6, the serial data signal received by the receiver 701 includes information on addresses allocated to the finely adjusted data Code. The number of bits allocated to the finely adjusted data Code may be, for example, 7, but is not limited thereto. A lower bit d0 positioned at the right side of the finely adjusted data Code may determine whether the finely adjusted data Code is stored in only the register or is stored in both of the memory 735 and the resister. For example, when the lower bit d0 is "1", the finely adjusted data Code may be stored in both of the memory 735 and the register of the second digital to analog converter 737, and when the lower bit d0 is "0", the finely adjusted data Code may be stored in only the register.

The first digital to analog converter 727 included in the driving voltage setting unit 725 converts the initially set data DATA_SET stored in the register into the first reference voltage VREF1, which is an analog voltage, and outputs the first reference voltage VREF1 to the first amplifier OA1.

The first amplifier OA1 amplifies a difference between the first reference voltage VREF1 and the feedback voltage FB that depends on the current flowing through the first and second resistors R1 and R2 of the feedback sensing unit 740 and the current flowing through the third resistor R3 of the driving voltage trimmer 730, and the first amplifier OA1 outputs the amplified voltage to the second amplifier OA2.

The second amplifier OA2 compares the output of the first amplifier OA1 with the reference signal RS input from the oscillator OSC and generates the control signal CS depending on the comparison result.

The driving voltage trimmer 730 adjusts a current flowing in the transistor Q1 depending on an increase and decrease in the finely adjusted data Code based on the set driving voltage AVDD when the finely adjusted data Code stored in the register of the second digital to analog converter 737 is the default value, allowing a magnitude of the driving voltage AVDD to be finely adjusted.

For example, when the finely adjusted data Code increases with respect to the default value, the current of the transistor Q1 is decreased, and thus, a voltage applied to the third resistor R3 is decreased. In this case, the feedback voltage FB input to the inverting terminal of the first amplifier OA1 becomes smaller than the first reference voltage VREF1. Accordingly, a duty ratio of the control signal CS output from the second amplifier OA2 is controlled, and thus, a magnitude of the driving voltage AVDD output from the DC to DC converter 710 is increased. Such change in the driving voltage AVDD may also be confirmed from the above Equation 4.

When the finely adjusted data Code decreases with respect to the default value, the current of the transistor Q1 is increased, and thus, a voltage applied to the third resistor R3 is increased. In this case, the feedback voltage FB input to the inverting terminal of the first amplifier OA1 becomes larger than the first reference voltage VREF1. Accordingly, a duty ratio of the control signal CS output from the second amplifier OA2 is controlled, decreasing a magnitude of the driving voltage AVDD output from the DC to DC converter 710. Such change in the driving voltage AVDD may also be confirmed from the above Equation 4.

When a finely adjusted rate of the driving voltage AVDD is set to 1/1000, and the finely adjusted data Code is changed by 1 with respect to the default value, the magnitude of the driving voltage AVDD may be changed by about 0.1%, and a driving voltage AVDD having a desired level may be output.

According to an exemplary embodiment of the present invention, the driving voltage AVDD generated by the driving voltage generating device 700 is finely adjusted, allowing the driving voltage AVDD to be closer to a target value.

FIG. 7 is a table showing illustrative magnitudes of driving voltages depending on initially set data DATA_SET input to the driving voltage generating device according to an exemplary embodiment of the present invention, and FIG. 8 is a table showing magnitudes of driving voltages depending on initially set data DATA_SET and finely adjusted data Code input to the driving voltage generating device according to an exemplary embodiment of the present invention.

Referring to FIG. 7, when the finely adjusted data Code input to the driving voltage generating device 700 according to an exemplary embodiment of the present invention is constantly maintained as the default value, the magnitude of the driving voltage AVDD is set by the initially set data DATA_SET. As shown in FIG. 7, the initially set data DATA_SET is given in the form of a hex file, by way of example.

Referring to FIG. 7, the driving voltage AVDD may be adjusted in minimum voltage units depending on the initially set data DATA_SET. The minimum voltage may be, for example, about 0.1 V. Therefore, when a deviation between driving voltages AVDD is generated in the minimum or less voltage units, for example, in 0.1 V or less units by each of a plurality of driving voltage generating devices 700, magnitudes of the driving voltages AVDD generated by the plurality of driving voltage generating devices 700 are not easy to accord with each other, and the driving voltages AVDD is difficult to precisely adjust.

However, referring to FIG. 8, when the driving voltage generating device 700 according to an exemplary embodiment of the present invention finely adjusts the driving voltage AVDD depending on the finely adjusted data Code, the driving voltage AVDD may be more precisely adjusted depending on each finely adjusted data Code with respect to each initially set data DATA_SET. For example, the finely adjusted data Code is changed from 0 to 127 with respect to one initially set data DATA_SET, thus allowing the driving voltage AVDD to be finely adjusted by a voltage smaller than the minimum voltage.

According to an exemplary embodiment of the present invention, the driving voltage AVDD may be adjusted in units of about 0.1% of the driving voltage AVDD (for example, 15 V) when the finely adjusted data Code is the default value, with respect to the same initially set data DATA_SET. When considering all of the initially set data DATA_SET and all of the finely adjusted data Code, the driving voltage AVDD may be finely adjusted even in units of about 0.005 V or less. For example, referring to FIG. 8, when the initially set data DATA_SET is 95h and the finely adjusted data Code is 64, the driving voltage AVDD is 15 V, and when the initially set data DATA_SET is 94h and the finely adjusted data Code is 71, the driving voltage AVDD is 15.004 V. Therefore, when the initially set data DATA_SET and the finely adjusted data Code are adjusted, a difference between the driving voltages AVDD may be adjusted to 0.004 V.

Therefore, the finely adjusted data Code is adjusted, allowing the driving voltage AVDD to be precisely adjusted. Accordingly, a difference from a target driving voltage AVDD may be reduced, and a difference between the plurality of driving voltages AVDD generated by the plurality of driving voltage generating devices 700 may be adjusted in up to 0.001 V units.

The units in which the driving voltage AVDD is finely adjusted may be variously changed by controlling magnitudes of the resistors R1, R2, and R3 included in the driving voltage generating device 700, the number of bits of the finely adjusted data Code, and the like.

Figure 9:
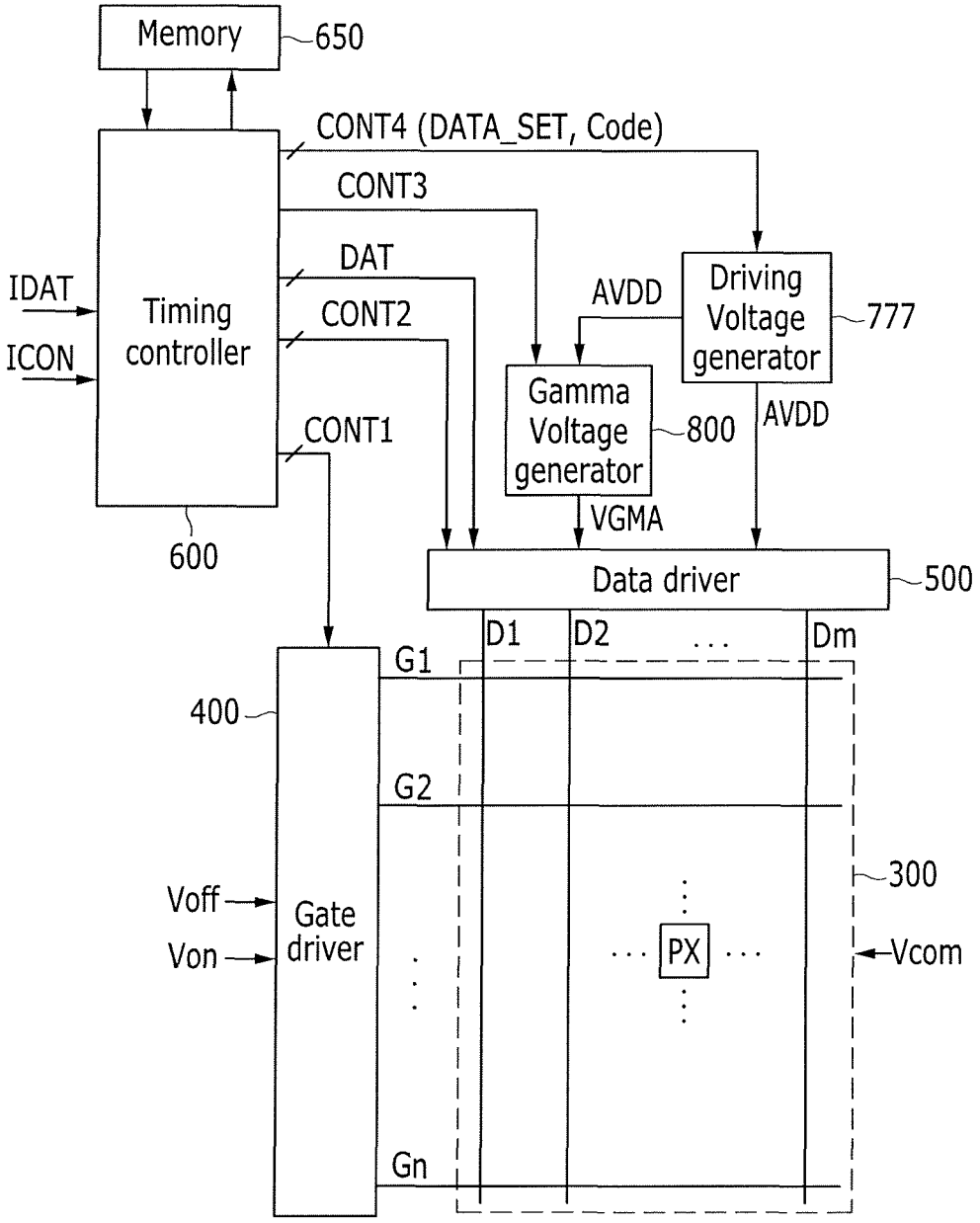
FIG. 9 is a block diagram of a display device according to an exemplary embodiment of the present invention.
Figure 10:
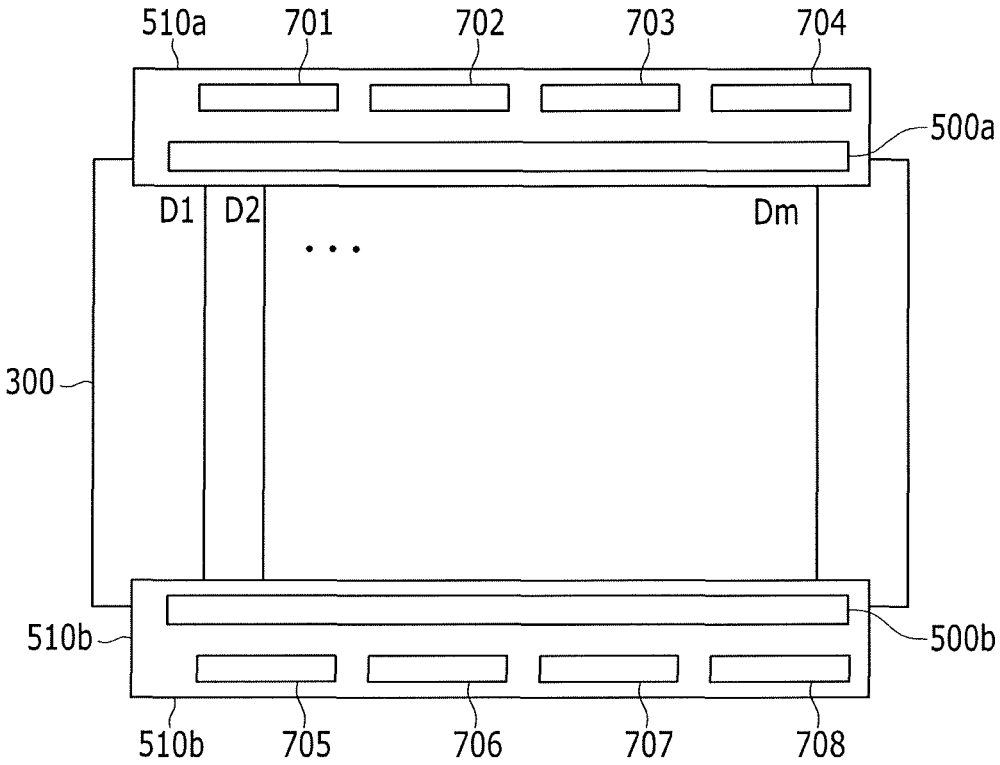
FIG. 10 is a layout view of the display device according to an exemplary embodiment of the present invention.

FIG. 9 is a block diagram of a display device according to an exemplary embodiment of the present invention, and FIG. 10 is a layout view of a display device according to an exemplary embodiment of the present invention.

Referring to FIG. 9, the display device according to an exemplary embodiment of the present invention includes a display panel 300, a gate driver 400 and a data driver 500 that are connected to the display panel 300, a gamma voltage generator 800 connected to the data driver 500, a driving voltage generator 777, a timing controller 600 controlling the display panel 300, the gate driver 400, the data driver 500, the gamma voltage generator 800, and the driving voltage generator 777, and a memory 650.

The display panel 300 includes a plurality of signal lines and a plurality of pixels PX connected to the plurality of signal lines. The pixels PX are arranged substantially in a matrix form. When the display device according to an exemplary embodiment of the present invention is a liquid crystal display, the display panel 300 may include lower and upper display panels (not shown) facing each other and a liquid crystal layer (not shown) interposed between the lower and upper display panels.

The signal lines include a plurality of gate lines G1 to Gn transferring gate signals (also referred to as "scanning signals") and a plurality of data lines D1 to Dm transferring data voltages. The gate lines G1 to Gn may extend in parallel with each other in a row direction. The data lines D1 to Dm may extend in parallel with each other in a column direction.

One pixel PX may include at least one switching element connected to at least one data line D1 to Dm and at least one gate line G1 to Gn, and at least one pixel electrode (not shown) connected to the switching element. The switching element may include at least one thin film transistor, and the switching element may be controlled by a gate signal transferred through its corresponding one of the gate lines G1 to Gn and transfers a data voltage from its corresponding one of the data lines D1 to Dm to the pixel electrode of each pixel PX.

Each pixel PX may display a primary color (spatial division) or alternately display primary colors over time (time division), and a desired color is displayed by a spatial or temporal sum of primary colors. Examples of the primary colors may include red, green, blue, yellow, cyan, and magenta. A plurality of pixels PXs that display different primary colors and that are adjacent to each other or not may form a set (referred to as a dot), and one dot may display a white image.

The timing controller 600 receives an input image signal IDAT and an input control signal ICON from a graphics controller (not shown) or the like and controls operations of the gate driver 400, the data driver 500, the gamma voltage generator 800, the driving voltage generator 777, and the like.

The input image signal IDAT includes information on the luminance of each pixel PX, and the luminance may be represented in a predetermined number of grays, for example $1024=2^{10}$, $256=2^{8}$, or $64=2^{6}$ grays. The input image signal IDAT may be provided for each primary color represented by the pixel PX. Examples of the input control signal ICON may include a vertical synchronization signal, a horizontal synchronization signal, a main clock signal, a data enable signal, and the like.

The memory 650 may store information such as the initially set data DATA_SET, the finely adjusted data Code, and the like. The memory 650 may further store gamma information.

The timing controller 600 processes the input image signal IDAT based on the input image signal IDAT and the input control signal ICON and converts the input image signal IDAT into an output image signal DAT, and the timing controller 600 generates a gate control signal CONT1, a data control signal CONT2, a gamma control signal CONT3, a driving voltage control signal, CONT4, and the like.

The gate control signal CONT1 includes a scanning start signal STV instructing the gate driver 400 to start scanning of the gate signal and at least one gate clock signal controlling an output period of a gate-on voltage Von. The data control signal CONT2 includes a horizontal synchronization start signal informing the data driver 500 that transmission of the output image signal DAT to one row of pixels PXs starts, a data load signal instructing the data driver 500 to apply an analog data voltage to the data lines D1 to Dm, and the like. The gamma control signal CONT3 includes information on the gamma information. The driving voltage control signal CONT4 may include information on the driving voltage AVDD stored in the memory 650, for example, the initially set data DATA_SET and the finely adjusted data Code.

The driving voltage generator 777 generates at least one driving voltage AVDD depending on the driving voltage control signal CONT4 from the timing controller 600. The driving voltage generator 777 may include at least one driving voltage generating device 700 according to an exemplary embodiment of the present invention.

The driving voltage generator 777 may transmit the driving voltage AVDD to the gamma voltage generator 800 and the data driver 500.

The gamma voltage generator 800 generates all or a limited number of the grayscale voltages (such a limited number of grayscale voltages are referred to as "reference grayscale voltages") GMA associated with transmittance of the pixels PXs using the driving voltage AVDD, or the like, depending on the gamma control signal CONT3. The grayscale voltages may include positive grayscale voltages and negative grayscale voltages with respect to a common voltage Vcom. The gamma voltage generator 800 transmits all the grayscale voltages or the reference grayscale voltages GMA to the data driver 500.

The gate driver 400 is connected to the gate lines G1 to Gn depending on the gate control signal CONT1 from the timing controller 600, generates a gate signal configured of a combination of a gate-on voltage Von and a gate-off voltage Voff, and applies the generated gate signal to the gate lines G1 to Gn.

The data driver 500 is connected to the data lines D1 to Dm, selects a grayscale voltage from the gamma voltage generator 800 based on the output image signal DAT received from the timing controller 600, and applies the selected grayscale voltage as the data voltage to the data lines D1 to Dm. However, when the gamma voltage generator 800 provides the reference grayscale voltages GMA, the data driver 500 may divide the reference grayscale voltages GMA to thus generate the grayscale voltages for all the grays and convert the output image signal DAT into the data voltage.

Each driving device, such as the gate driver 400 and the data driver 500 may be mounted in at least one integrated circuit (IC) chip on the display panel 300 or may be mounted on a flexible printed circuit film (not shown) in the form of a tape carrier package (TCP) or on a separate printed circuit board (PCB) (not shown). According to an exemplary embodiment of the present invention, the gate driver 400, together with the signal lines G1 to Gn and D1 to Dm and the thin film transistors, may be integrated in the display panel 300.

Referring to FIG. 10, the data driver 500 of the display device according to an exemplary embodiment of the present invention may include first and second data drivers 500*a* and 500*b* respectively positioned on upper and lower sides of the display panel 300 facing each other. FIG. 10 shows an example in which the first and second data drivers 500*a* and 500*b* are attached in chips onto first and second flexible printed circuit films 510*a* and 510*b* respectively attached to upper and lower sides of the display panel 300. However, exemplary embodiments of the present invention are not limited thereto.

The first and second data drivers 500*a* and 500*b* may receive reference grayscale voltages or all the grayscale voltages from different gamma voltage generators (not shown), and a plurality of gamma voltage generators may receive separate driving voltages AVDD from different driving voltage generating devices. A plurality of data driving circuits included in the first data driver 500*a* may receive reference grayscale voltages or all the grayscale voltages from a gamma voltage generator receiving driving voltages AVDD from a plurality of driving voltage generating devices 701 to 704, respectively, and a plurality of data driving circuits included in the second data driver 500*b* may receive all the reference grayscale voltages or grayscale voltages from a gamma voltage generator receiving driving voltages AVDD from a plurality of driving voltage generating devices 705 to 708, respectively. The driving voltage generating devices 701 to 708 may be positioned on the first and second flexible printed circuit films 510*a* and 510*b*. Although eight driving voltage generating devices 701 to 708 are shown in FIG. 10, the number of driving voltage generating devices 701 to 708 is not limited thereto.

As the size and resolution of the display device increase, the display device may include more driving voltage generating devices.

When one display device includes a plurality of driving voltage generating devices, a deviation between a plurality of driving voltages AVDD generated by the plurality of driving voltage generating devices may be generated. The deviation between the driving voltages AVDD may lead to a deviation between the grayscale voltages, thus causing dispersion in the gamma curves.

Figure 12:
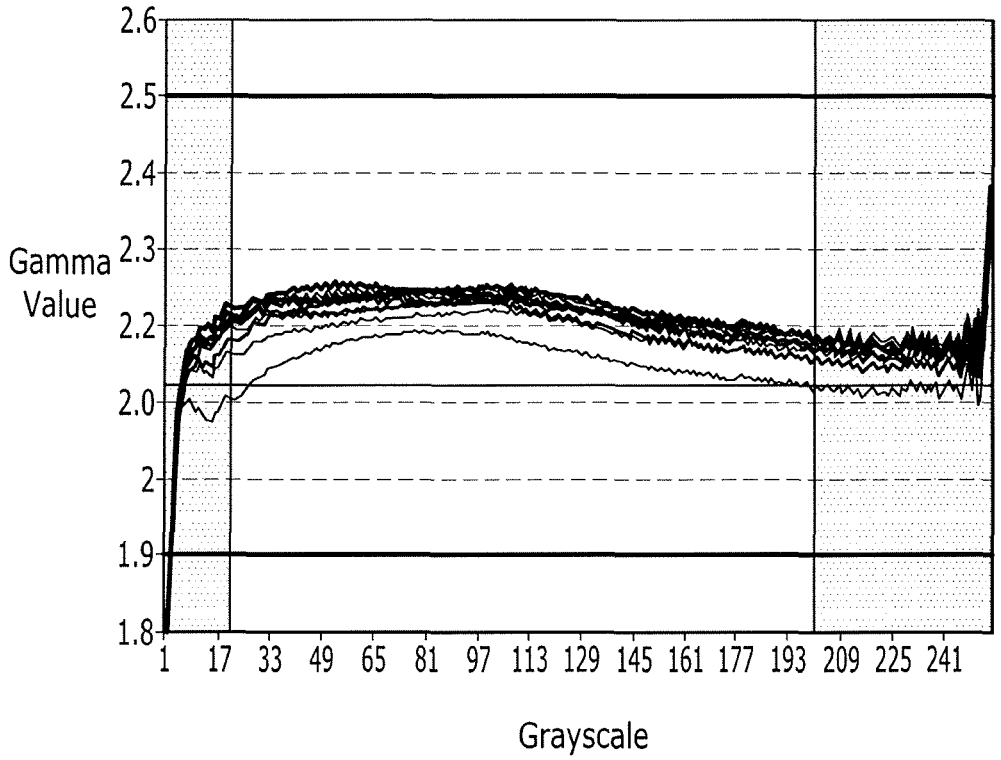
FIG. 12 is a graph showing a measurement result of gamma curves measured when a display device displays an image based on driving voltages as shown in FIG. 11, according to an exemplary embodiment of the present invention.
Figure 13:
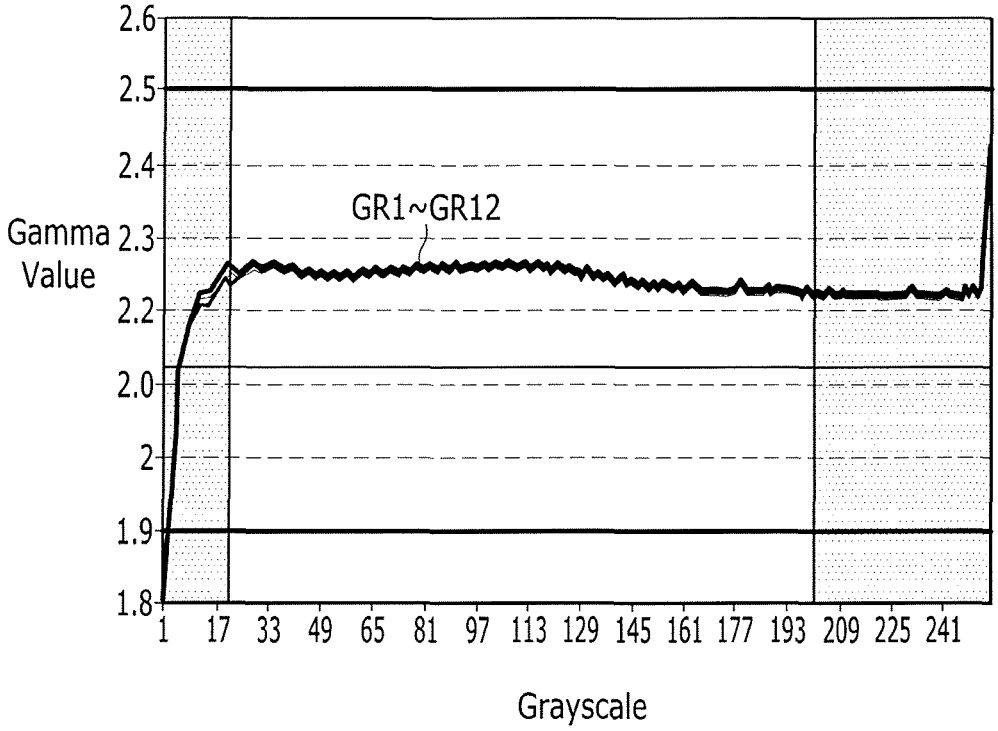
FIG. 13 is a graph showing a measurement result of gamma curves measured when a display device displays an image based on driving voltages generated by different driving voltage generating devices thereof, according to an exemplary embodiment of the present invention.

FIG. 11 is a table showing values of driving voltages generated by a plurality of driving voltage generating devices according to the related art. FIG. 12 is a graph showing measurement results of gamma curves measured when a display device displays an image based on driving voltages shown in FIG. 11, according to an exemplary embodiment of the present invention. FIG. 13 is a graph showing measurement results of gamma curves measured when a display device displays an image based on driving voltages generated by different driving voltage generating devices thereof, according to an exemplary embodiment of the present invention.

Referring to FIG. 11, when a plurality of driving voltage generating devices (for example, twelve driving voltage generating devices) generate driving voltages AVDD without finely adjusting the driving voltages AVDD, a deviation up to 0.19 V between the driving voltages AVDD may be present.

In this case, when the driving voltages AVDD are independently received and data voltages are generated based on the driving voltages to display an image, a large deviation may be generated between gamma curves, as shown in FIG. 12.

For example, when each driving voltage generating device and each gamma voltage generating unit are disposed at upper and lower portions of the display panel 300 as shown in FIG. 10, a difference is generated in luminance displayed by the data voltages of the first and second data drivers 500*a* and 500*b* connected to the driving voltage generating devices and gamma voltage generating units, and such luminance difference may be viewed as a spot.

However, the display device including the driving voltage generating device 700 according to an exemplary embodiment of the present invention may adjust the finely adjusted data Code, allowing the driving voltage AVDD to be finely adjusted to a predetermined minimum unit, for example, 0.001 V. Therefore, the display device including the driving voltage generating device 700 according to an exemplary embodiment of the present invention may finely adjust the driving voltages AVDD generated by the plurality of driving voltage generating devices, allowing a difference between the driving voltages AVDD to be, for example, 0.1% or less.

Therefore, even when the grayscale voltages are generated based on the driving voltages AVDD generated by different driving voltage generating devices, a deviation between gamma curves of images displayed by different data driving circuits may be substantially removed, as shown in FIG. 13. Therefore, a display defect such as a spot, due to the deviation between the grayscale voltages may be decreased. FIG. 13 shows gamma curves GR1 to GR12 of images displayed by data voltages generated based on driving voltages AVDD output from twelve different driving voltage generating devices when the driving voltages AVDD are finely adjusted according to an exemplary embodiment of the present invention.

Figure 14:
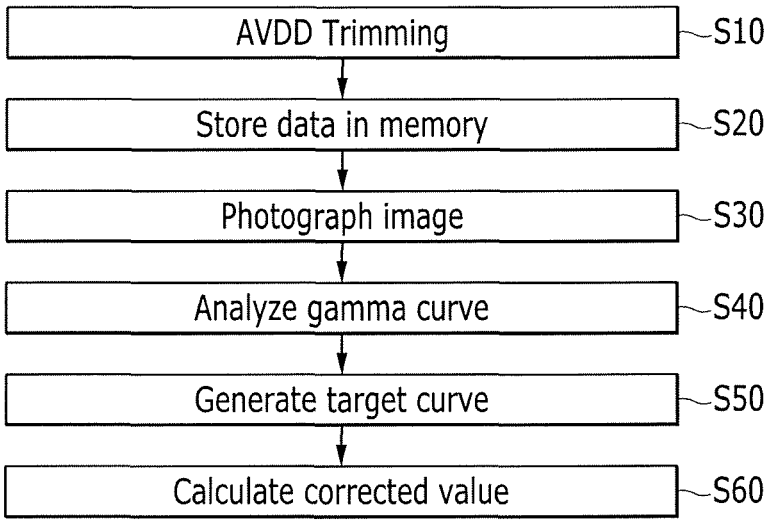
FIG. 14 is a flowchart showing a method of correcting a spot of a display device according to an exemplary embodiment of the present invention.

FIG. 14 is a flowchart showing a method of correcting a spot of a display device according to an exemplary embodiment of the present invention.

Before photographing a display image, a driving voltage AVDD deviating from a target driving voltage AVDD is finely adjusted using the finely adjusted data Code as in an exemplary embodiment of the present invention, and thus, a difference between an actually output driving voltage AVDD and the target driving voltage AVDD is adjusted to be about 0.1% or less (S10).

Data on the finely adjusted driving voltage AVDD is stored in a memory (S20). The data on the finely adjusted driving voltage AVDD may be stored in all of the memories 650 and 735 and the registers of the driving voltage setting unit 725 and the driving voltage trimmer 730.

An image is photographed (S30), and a gamma curve is measured and analyzed based on the luminance of the photographed image (S40).

A target gamma curve is generated (S50), and a corrected value of the measured gamma curve is calculated based on the target gamma curve (S60).

According to an exemplary embodiment of the present invention, the deviation between the driving voltages AVDD may be previously removed and a spot may be prevented from occurring in advance.

While this invention has been shown and described in connection with exemplary embodiments thereof, it is to be understood by those of ordinary skill in the art that various changes in form and detail may be made thereto without departing from the spirit and scope of the present invention as defined by the appended claims.

What is claimed is:

1. A driving voltage generating device, comprising:

a driving voltage setting unit including a first terminal receiving first data having information on a value of a driving voltage, a second terminal receiving a feedback voltage, and an output terminal outputting a control signal;

a gamma voltage generator configured to receive the driving voltage and configured to generate a plurality of reference grayscale voltages based on the driving voltage;

a feedback sensing unit including a fourth terminal outputting the feedback voltage to the driving voltage setting unit;

a driving voltage trimmer including a third terminal receiving second data for adjusting the driving voltage, the driving voltage trimmer connected to the second terminal and the fourth terminal for adjusting the feedback voltage thereby adjusting the driving voltage; and a DC to DC converter configured to generate the driving voltage based on the control signal and an input voltage.

2. The driving voltage generating device of claim 1, wherein the driving voltage trimmer includes a switching element configured to allow different currents to flow depending on a value of the second data.

3. The driving voltage generating device, comprising:

a driving voltage setting unit configured to receive first data on a driving voltage and a feedback voltage and configured to output a control signal;

a driving voltage trimmer configured to receive second data on the driving voltage and configured to adjust the feedback voltage; and a DC to DC converter configured to generate the driving voltage based on the control signal and an input voltage, wherein the driving voltage trimmer includes a switching element configured to allow different currents to flow depending on a value of the second date, wherein the driving voltage setting unit includes a first digital to analog converter configured to receive the first data, a first amplifier configured to receive a first reference voltage from the first digital to analog converter and the feedback voltage, and a second amplifier configured to receive an output voltage of the first amplifier and configured to output the control signal, and wherein the driving voltage trimmer includes a second digital to analog converter configured to receive the second data, a third amplifier configured to receive a second reference voltage from the second digital to analog converter, and the switching element including a control terminal receiving an output voltage of the third amplifier.

4. The driving voltage generating device of claim 3, further comprising a feedback sensing unit connected to an output terminal of the DC to DC converter, the feedback sensing unit including first and second resistors connected in series with the output terminal, wherein the feedback voltage is sensed at a first node between the first resistor and the second resistor and is input to the second amplifier, and wherein a first terminal of the switching element is connected to the first node.

5. The driving voltage generating device of claim 4, wherein the driving voltage trimmer further includes a third resistor connected to a second terminal of the switching element, and wherein the second terminal of the switching element is connected to the third amplifier.

6. The driving voltage generating device of claim 5, wherein the driving voltage trimmer further includes a first memory storing the second data.

7. The driving voltage generating device of claim 6, wherein the first data and the second data are received through an $I^2C$ interface.

8. The driving voltage generating device of claim 7, wherein the first to third resistors are configured to satisfy the following equation:

$$R3=R2\times\{R1/(R1+R2)\}\times[\{M-(\text{default}+1)\}/2^n]$$

wherein R1 indicates a resistance of the first resistor, R2 indicates a resistance of the second resistor, R3 indicates a resistance of the third resistor, M is a natural number larger than 1, and default indicates a default value of the second data.

9. A display device comprising:

a display panel including a plurality of pixels and a plurality of signal lines;

a data driver configured to apply a data voltage to the plurality of signal lines;

a driving voltage generator including at least one driving voltage generating device, the at least one driving voltage generating device configured to generate the driving voltage;

a gamma voltage generator configured to receive the driving voltage and configured to generate a plurality of reference grayscale voltages based on the driving voltage; and a timing controller configured to control the gamma voltage generator, the driving voltage generator, and the data driver, wherein the at least one driving voltage generating device includes:

a driving voltage setting unit including a first terminal receiving first data having information on a value of a driving voltage, a second terminal receiving a feedback voltage, and an output terminal outputting a control signal;

a feedback sensing unit including a fourth terminal outputting the feedback voltage to the driving voltage setting unit;

a driving voltage trimmer including a third terminal receiving second data for adjusting the driving voltage, the driving voltage trimmer connected to the second terminal and the fourth terminal for adjusting the feedback voltage thereby adjusting the driving voltage; and a DC to DC converter configured to generate the driving voltage based on the control signal and an input voltage.

10. The display device of claim 9, wherein the driving voltage trimmer includes a switching element configured to allow different currents to flow depending on a value of the second data.

11. A display device comprising:

a display panel including a plurality of pixels and a plurality of signal lines;

a data driver configured to apply a data voltage to the plurality of signal lines;

a driving voltage generator including at least one driving voltage generating device, the at lease one driving voltage generating device configured to generate the driving voltage;

a gamma voltage generator configured to receive the driving voltage and configured to generate a plurality of reference grayscale voltages; and a timing controller configured to control the gamma voltage generator, the driving voltage generator, and the data driver, wherein the at least one driving voltage generating device includes:

a driving voltage setting unit configured to receive first data on the driving voltage and a feedback voltage and configured to output a control signal;

a driving voltage trimmer configured to receive second data on the driving voltage and configured to adjust the feedback voltage; and a DC to DC converter configured to generate the driving voltage based on the control signal and an input voltage;

wherein the driving voltage trimmer includes a switching element configured to allow different currents to flow depending on a value of the second date, wherein the driving voltage setting unit includes a first digital to analog converter configured to receive the first data, a first amplifier configured to receive a first reference voltage from the first digital to analog converter and the feedback voltage, and a second amplifier configured to receive an output voltage of the first amplifier and configured to output the control signal; and wherein the driving voltage trimmer includes a second digital to analog converter configured to receive the second data, a third amplifier configured to receive a second reference voltage from the second digital to analog converter, and the switching element including a control terminal receiving an output voltage of the third amplifier.

12. The display device of claim 11, further comprising: a feedback sensing unit connected to an output terminal of the DC to DC converter, the feedback sensing unit including first and second resistors connected in series with the output terminal, wherein the feedback voltage is sensed at a first node between the first resistor and the second resistor and is input to the second amplifier, and wherein a first terminal of the switching element is connected to the first node.

13. The display device of claim 12, wherein the driving voltage trimmer further includes a third resistor connected to a second terminal of the switching element, and wherein the second terminal of the switching element is connected to the third amplifier.

14. The display device of claim 13, wherein the driving voltage trimmer further includes a first memory storing the second data.

15. The display device of claim 14, wherein the first data and the second data are received through an $I^2C$ interface.

16. The display device of claim 15, wherein the first to third resistors satisfy the following equation:

$$R3=R2\times\{R1/(R1+R2)\}\times[\{M-(\text{default}+1)\}/2^n]$$

wherein R1 indicates a resistance of the first resistor, R2 indicates a resistance of the second resistor, R3 indicates a resistance of the third resistor, M is a natural number larger than 1, and default indicates a default value of the second data.

17. A method of generating a driving voltage by a driving voltage generating device including a driving voltage setting unit, a driving voltage trimmer, and a DC to DC converter, the method comprising:

receiving first data and second data on a driving voltage from an outside source;

converting, by the driving voltage setting unit, the first data into a first reference voltage;

converting, by the driving voltage trimmer, the second data into a second reference voltage;

adjusting, by the driving voltage trimmer, a magnitude of a current flowing in a switching element included in the driving voltage trimmer according to the second reference voltage;

amplifying, by the driving voltage setting unit, a difference between a feedback voltage depending on the current flowing in the switching element and the first reference voltage to output a first output voltage;

comparing, by the driving voltage setting unit, the first output voltage with a reference signal to output a control signal; and generating, by the DC to DC converter, the driving voltage according to the control signal.

18. The method of claim 17, wherein the driving voltage generating device further includes a feedback sensing unit connected to an output terminal of the DC to DC converter, the feedback sensing unit including first and second resistors connected in series with the output terminal, wherein the feedback voltage is sensed at a first node between the first resistor and the second resistor, and wherein a first terminal of the switching element is connected to the first node.

19. The method of claim 18, wherein the driving voltage trimmer includes a third resistor connected to a second terminal of the switching element.

20. The method of claim 19, wherein the first data and the second data are received through an $I^2C$ interface.

21. A driving voltage generating device, comprising:

a driving voltage setting unit configured to receive first data for initially setting a driving voltage and a feedback voltage and configured to output a control signal based on the initial data and the feedback voltage, wherein the feedback voltage is a divided voltage of the driving voltage;

a driving voltage trimmer configured to receive second data for adjusting the driving voltage and configured to adjust the feedback voltage depending on the number of bits assigned to the second data; and a DC to DC converter configured to generate the driving voltage based on the control signal and an input voltage.

* * * * *